United States Patent [19]

Saller et al.

[11] Patent Number: 4,766,367

[45] Date of Patent: Aug. 23, 1988

[54] CURRENT MIRROR WITH UNITY GAIN BUFFER

[75] Inventors: Kenneth R. Saller; Alan J. Baker; Steven O. Smith, all of Fort Collins, Colo.

[73] Assignee: Comlinear Corporation, Fort Collins, Colo.

[21] Appl. No.: 75,140

[22] Filed: Jul. 20, 1987

[51] Int. Cl.[4] ..... G05F 3/26

[52] U.S. Cl. ..... 323/315; 323/316; 330/288

[58] Field of Search ..... 323/315, 316, 317; 330/288

[56] References Cited

U.S. PATENT DOCUMENTS 3,930,172 12/1975 Dobkin ..... 323/315

FOREIGN PATENT DOCUMENTS 67447 12/1982 European Pat. Off. ..... 323/315

171110 10/1983 Japan ..... 330/288

*Primary Examiner*—William H. Beha, Jr.

*Attorney, Agent, or Firm*—Dean P. Edmundson

[57] ABSTRACT

An improved current mirror is described which has utility as either a stand alone current source or as a gain block whenever current gain or transimpedance gain is required. When used as a current source the current mirror exhibits higher output impedance, and when used as a gain block, the current mirror exhibits improved higher frequency performance and high transimpedance gain than prior art current mirrors.

7 Claims, 2 Drawing Sheets

CURRENT MIRROR WITH UNITY GAIN BUFFER

FIELD OF THE INVENTION

This invention relates to current mirrors. More particularly, this invention relates to improved current mirrors useful as stand alone current sources or as gain blocks.

BACKGROUND AND SUMMARY OF THE INVENTION

Current mirrors have become one of the basic building blocks for electronic circuits. They are useful both as stand alone current sources and/or as gain blocks, depending on the application. The important characteristics of a current mirror for good dynamic performance are high output impedance and low output capacitance, which then approach the ideal current mirror of infinite output impedance over all frequencies. A new circuit topology is offered that has superior performance over prior art current mirrors in the areas of DC and AC performance. The invention provides a current mirror with higher output impedance at both DC and high frequencies, and when used as a gain block, higher transimpedance gain at both DC and high frequencies, than prior art mirrors. Prior art mirrors and their characteristics are described, for example, in *Analysis and Design of Analog Integrated Circuits,* Paul R. Gray and Robert G. Meyer (2nd edition), incorporated herein by reference.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE ILLUSTRATED EMBODIMENTS

Figure 1:
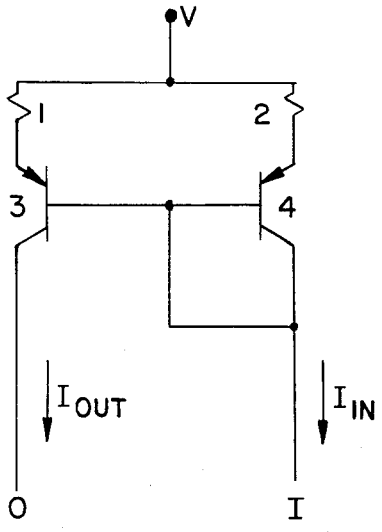
FIG. 1 PRIOR ART
FIGS. 1, 2, and 3 are schematic diagrams of prior art simple current mirrors.
Figure 2:
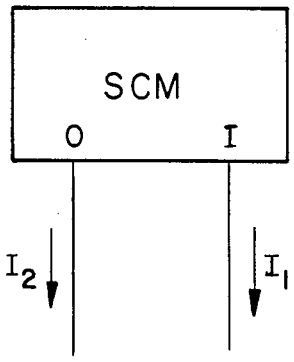
FIG. 2 PRIOR ART

In FIG. 1 there is shown a simple current mirror known in the art. Neglecting the base current of transistor 3 and transistor 4, the output current Iout is equal to the input current Iin, times a scale factor $\alpha$. Thus Iout $=\alpha$*Iin, and $\alpha$ is a function of resistors 1 and 2 and the emitter areas of transistors 3 and 4. The output impedance at the collector of transistor 3 is proportional to the early voltage, Va, of transistor 3, and also to the voltage drop across resistor 1. The simple current mirror always includes a bias terminal, V, which is connected to a voltage source of correct polarity to provide the current required by the simple current mirror. We shall represent a simple current mirror (SCM) schematically as shown in FIG. 2, where the relationship holds that the current I2 is equal to the current I1 times a scale factor $\alpha$.

Figure 3:
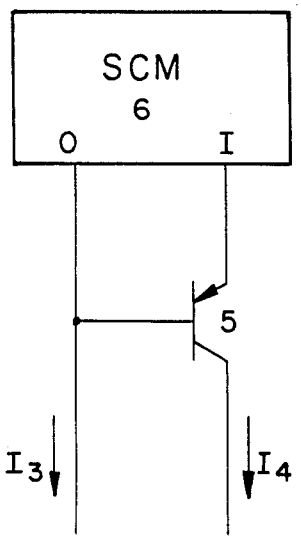
FIG. 3 PRIOR ART

The circuit shown in FIG. 3 is a commonly used current mirror in the prior art that uses a simple current mirror 6 and transistor 5 in a feedback configuration to obtain better performance than the simple current mirror. Again neglecting the base current of transistor 5, the output current I4 is equal to the input current I3 times the scale factor $1/\alpha$, where $\alpha$ is defined as before for the simple current 6. Let us call the term $1/\alpha$ the current gain G. Then rewriting the above equation, I4=G*I3, again neglecting the base current of transistor 5. One advantage of this type of current mirror, which is commonly called a Wilson current mirror, is the increase in output impedance at the collector of transistor 5. By using standard engineering math, the output impedance Ro can be written as $$Ro = \frac{Va}{I4} * \frac{1 + \frac{1}{G} * (B + 1)}{1 + \frac{1}{G} * \left(1 + \frac{Vt}{Va}\right)} \tag{7}$$

where Va is the Early Voltage, B is the small signal current gain of transistor 5, Vt=KT/q, where K is Boltzman's constant, T is temperature, and q is the electronic charge, and G is the current gain equal to I4/I3. Now let us define ro=Va/I4, and let B>>1 and Vt<<Va, which are considered normal engineering assumptions. Equation (7) above then simplifies to $$Ro \approx ro * \frac{B}{1 + G} \tag{8}$$

Thus we see that the output impedance Ro is equal to the output impedance of transistor 5, which is ro, times the scale factor B/(1+G), which is usually >>1. Thus the Wilson current mirror can have higher output impedance than a simple current mirror.

Another advantage of the Wilson current mirror is base current cancellation when $\alpha=1$ and thus G=1. It can be shown that (REF 1) a simple current mirror as shown in FIG. 1 the output current I4 (FIG. 3) is equal to the input current I3 to within an accuracy of $\approx 2/B^2$, thus providing an accurate replica of the input current I3.

As can be seen from equation 8, the output impedance is inversely proportional to the current gain G. As the current gain G is thus increased, the advantage of using this type of current mirror to improve output impedance is lost.

Another problem associated with this type of current mirror is the degradation in high frequency performance due to the collector-base capacitance of transistor 5. This capacitance determines in part the high frequency output impedance at the collector of transistor 5. This collector-base capacitance of transistor 5 is effectively multiplied by the current gain G, and thus the capacitance seen at the collector of transistor 5 due to collector-base capacitance of transistor 5 is equal to $$Ceff = Ccb(1+G)$$

where Ccb is the collector base capacitance of transistor 5, and Ceff is the effective capacitance due to the current gain G. Thus as the current gain G is increased, the effective amount of capacitance connected to the output of the current mirror increases, thus decreasing the high frequency performance of the mirror.

Figure 4:
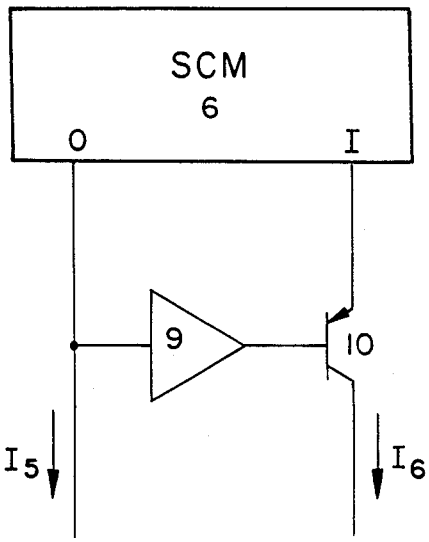
FIGS. 4, 5, 6, 7 and 8 are schematic diagrams of improved current mirrors of the invention.

To overcome these performance degradations, the present invention uses a new circuit topology. This topology, shown in FIG. 4, uses a unity gain buffer 9 whose input is connected to the output of the simple current mirror 6, and whose output is connected to the base of transistor 10. The buffer's characteristics are very high input impedance, ideally infinite, very low output impedance, ideally zero ohms, a voltage gain of one from input to output, and a reverse voltage gain of zero from output to input. The output current I6 is equal to the input current I5 times the current gain G, where $G=1/\alpha$ and $\alpha$ is defined as before for the simple current mirror 6. Again, base currents are neglected and in equation form $$I6=G*I5$$

Using standard engineering math, the output impedance, Ro, of the current mirror at the collector of transistor 10 is equal to $$Ro=B*ro$$

where B is the small signal current gain of transistor 10 and ro is equal to Va/I6, and Va is the early voltage of transistor 10. Thus it is seen that this new circuit topology has increased the output impedance over the prior art mirror, and the output impedance has no dependency on the current gain G, thus allowing high current gain and high output impedance simultaneously.

Another advantage of this circuit topology is the decoupling of the collector-base capacitance of transistor 10. As the output signal on the collector of transistor 10 is coupled to the base of transistor 10 thru the collector-base capacitance, the buffer prevents the signal from propagating back into the simple current mirror. Thus the effective capacitance, Ceff, connected to the collector of transistor 10 due to the collector-base capacitance of transistor 10 is just equal to the collector-base capacitance, or $$Ceff=Ccb$$

Thus, the high frequency contribution to output impedance of the collector-base capacitance does not change as the current gain G is increased, thus allowing much higher output impedance at high frequencies than the prior art mirror, especially for high current gain G. It is thus seen that the new circuit topology has advantages over the prior art mirror in the areas of both DC and AC performance.

Figure 5:
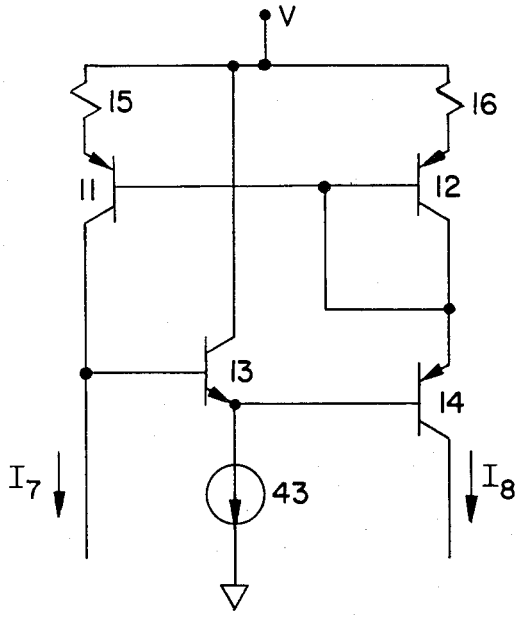

In FIG. 5 there is shown the preferred embodiment of the invention. Transistors 11 and 12 and resistors 15 and 16 form a simple current mirror. Transistor 13, biased on by current source 43, constitutes the unity gain buffer, where the base of transistor 13 is the input of the buffer and the emitter of transistor 13 is the output of the buffer. The collector of the transistor 13 is shown connected to the bias terminal, V, but it could instead be connected to any other bias source which allows proper biasing of transistor 13. Current source 43 can be constructed by any of the known methods, including but not limited to a simple resistor. The output of the current mirror is the collector of transistor 14. Neglecting base curents, the output current I8 is equal to the input current, I7, times the current gain G, or $$I8=G*I7$$

where G is defined as before for the simple current mirror.

The output impedance of the current mirror, at the collector of transistor 14, can be found using standard engineering math and approximations. Doing this, we find that the output impedance, Ro, of the current mirror is $$Ro=ro*B^2/B+G \qquad (26)$$

This was done assuming the B of transistor 13 and the B of transistor 14 are approximately equal, and both are set equal to B in the above equation. Now in general, $B>>G$, and this equation simplifies to $$Ro=B*ro$$

and thus the output impedance of the current mirror is independent of the current gain G to a first order approximation. This embodiment gives the best performance for the fewest number of parts. One drawback of this embodiment however, is the inability to cancel base currents, as can be seen by the more exact equation relating I8 and I7

$$I8=G*I7+G*In+Ip$$

where In is the base current of transistor 13 and Ip is the base current of transistor 11. Thus the output current contains an undesired component due to base currents as well as the desired scaled replica of the input current I7.

Figure 6:
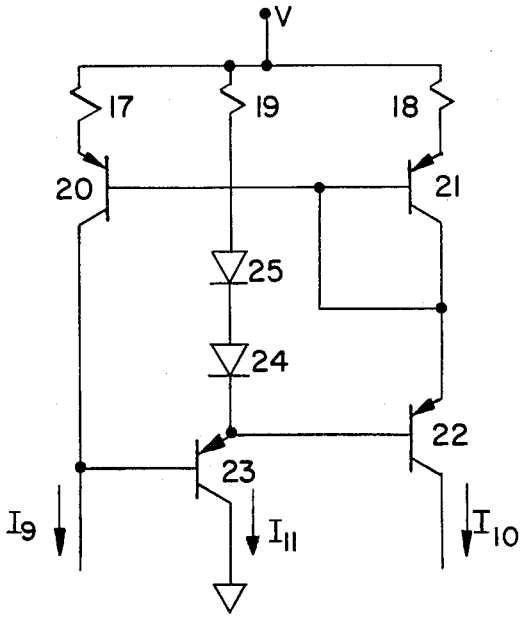
Figure 7:
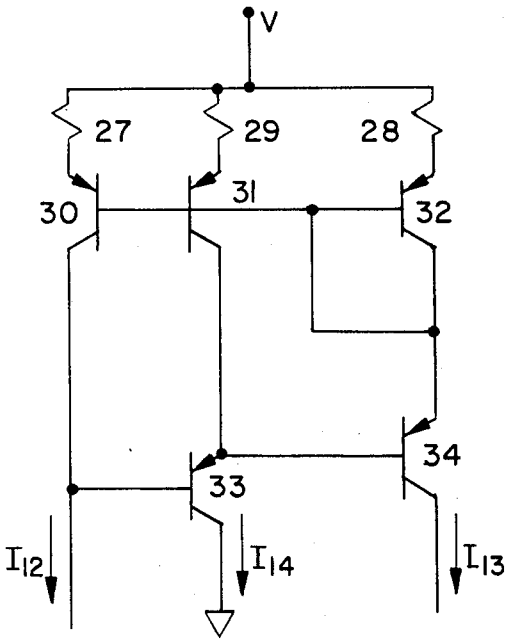

In FIGS. 6 and 7 there are shown embodiments of the invention that provide the possibility to cancel base currents to a first order approximation, neglecting any contribution that is proportional to $1/B^2$.

In FIG. 6, transistors 20 and 21 and resistors 17 and 18 form a simple current mirror. Transistor 23 constitutes the unity gain buffer, where the base of transistor 23 is the input of the buffer, and the emitter of transistor 23 is the output of the buffer. The bias current through transistor 23, shown as I11, is determined by diodes 24 and 25 and resistor 19. The collector of the transistor 23 is shown connected to ground, but it could instead be connected to any other bias source which allows proper biasing of transistor 23. By adjusting resistor 19, we can choose the current I11 to be equal to the input current I9 times a scale factor H, neglecting base current contributions. Thus $$I11=H*I9$$

Now, writing the equation that relates the output current I10 to the input current I9, we have $$I10=G*I9-(GH)*Ib+Ib$$

where Ib is equal to the base current of transistor 20, and again we have neglected any contribution of current proportional to $1/B^2$.

Since we can independently adjust the scale factor H, by adjusting the value of resistor 19, without affecting the current gain G, if we choose H to be equal to 1/G, the above equation then becomes $$I10=G*I9$$

and thus we see that the output current, I10, is a scaled replica of the input current, I9 without any undesired components due to base currents.

The output impedance of the current mirror in FIG. 6 is given by equation 26 above, and thus has the same increase in performance as the preferred embodiment of FIG. 5.

In FIG. 7 there is shown an embodiment similar to that of FIG. 6 but using fewer components. Transistors 30 and 32 and resistors 27 and 28 form a simple current mirror as before. Transistor 33 constitutes the buffer, where the base of transistor 33 is the input of the buffer, and the emitter of transistor 33 is the output of the buffer. Transistor 33 is biased on by transistor 31, whose current can be adjusted by the value of resistor 29. The collector of the transistor 33 is shown connected to ground, but it could instead be connected to any other bias source which allows proper biasing of transistor 33. By adjusting resistor 29 we can choose the current I14 to be equal to the input current I12 times a scale factor H, neglecting base current contributions. Thus $$I14 = H*I12$$

Then we can write the output current I13 as a function of input current I12 and scale factors G and H as:

$$I13 = G*I12 - (GH)*Ib + H*Ib + Ib$$

where Ib is the base current thru transistor 30. Again we have neglected terms proportional to $1/B^2$ in this equation. Now if we choose the scale factor H to be equal to $1/(G-1)$, then the equation above becomes $$I13 = G*I12$$

and again the output current I13 is equal to the current gain G times the input current I12 is without any desired components due to base currents. Note that this embodiment requires that, for H to be a positive number, $G>1$, which is slightly more restrictive than the embodiment shown in FIG. 7, but in general will apply in a large majority of applications.

The output impedance of the current mirror in FIG. 7 is given by equation 26 above, and thus has the same increase in performance as the preferred embodiment of FIG. 5.

Figure 8:
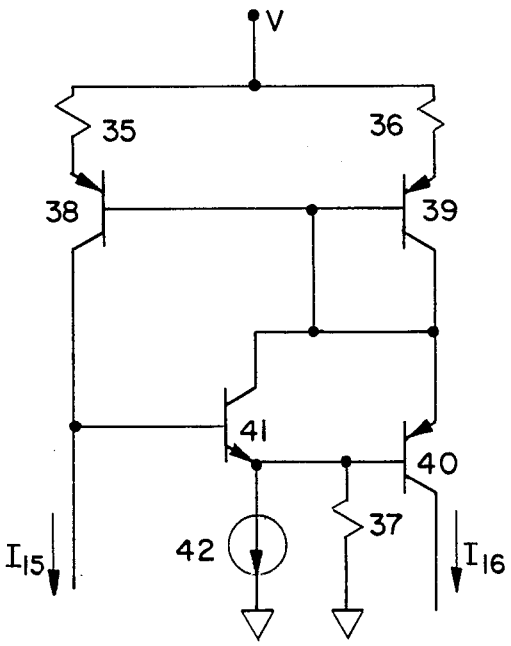

In FIG. 8 there is shown an embodiment that uses a composite Darlington configuration to obtain extremely high output impedance, and also allows the output impedance to be adjusted by varying a resistor. Transistors 38 and 39 and resistors 35 and 36 form a simple current mirror. Transistor 41, biased on by current source 42 and resistor 37, constitute the buffer. The base of transistor 41 is the input of the buffer, and the emitter of transistor 41 is the output of the buffer. Current source 42 can be constructed by any of the known methods in the art. The collector of transistor 41 is connected to the emitter of transistor 40, forming a composite Darlington to effectively increase the B of transistor 40 by a factor of B.

To see the effect of the composite Darlington on output impedance, let us first let resistor 37 go towards infinity and thus will be consistant with FIG. 5., where the parallel resistance of current source I5 is shown to be infinite. Doing this, we find that the output impedance of the current mirror at the collector of transistor 40 is:

$$Ro = \frac{ro*B^2}{(G+1)}$$

where $ro = Va/I16$ and Va is the early voltage of transistor 40, G is current gain, and B is the small signal current gain of transistors 40 and 41. Thus, we see that to a first approximation, this embodiment has approximately $B/(G+1)$ times higher output impedance than the three previous embodiments. This increase in output impedance is due to the effective increase in B of transistor 40 by using a composite darlington, whereby the base current of transistor 40 is fed back into its emitter by transistor 41.

To understand the effect of resistor 37 on the output impedance, we must consider the change in Vbe of transistor 40 as the collector voltage of transistor 40 is changed. To show this qualitatively, assume that the voltage on the collector of transistor 40 is decreased, thereby increasing the collector-emitter voltage of transistor 40. This increase in Vce has two major effects. First, the B of the transistor is increased, due to the Early effect, and the Vbe of the transistor is decreased, again due to the Early effect. The increase in B of transistor 40 increases the emitter current of transistor 41. In addition, since the Vbe of transistor 40 decreased, the voltage at the base of transistor 40 increases, since the voltage at the emitter of transistor 40 is held relatively constant. This increases the voltage across resistor 37, increasing the current through resistor 37, and this increase in current also adds to an increase in the emitter current of transistor 41. Since the purpose of transistor 41 is to effectively increase the B of transistor 40 by supplying any incremental base current change back to the emitter of transistor 40, any slight increase in the emitter current of transistor 41 that is not due to a change in base current of transistor 40 will effectively increase the B of transistor 40 even further. Quantitatively, the output impedance, Ro, of the current mirror at the collector of transistor 40 can be shown to be approximately $$Ro = \frac{1}{\frac{G+1}{B^2 ro} - \frac{1}{R37} * \frac{Vt}{Va}}$$

where R37 is resistor 37, $ro = Va/I16$, G is current gain, $Vt = KT/q$, and B is small signal current gain of transistors 40 and 41, which is assumed to be equal. This output impedance can be described as being the combination of two resistors in parallel. The first resistor has a value of $B^2ro/(G+1)$, which is the value of the output impedance when resistor 37 approaches infinity, or is removed. The second resistor has a value of $-R37*Va/Vt$, which is a negative resistance. Thus the total parallel resistance can be positive, negative, or infinite depending on the value of resistor 37 and the other parameters. The critical value for resistor 37 is $$Rcrit = ro * \frac{Vt}{Va} * \frac{B^2}{(G+1)}$$

and this can be simplified to $$Rcrit = \frac{1}{gm} * \frac{B^2}{G+1}$$

where $gm = I16/Vt$.

Thus for values of resistor 37 that are greater than Rcrit, the output impedance of the current mirror is positive. For values of resistor 37 that are less than Rcrit, the output impedance of the current mirror is negative. When resistor 37 equals Rcrit, the output impedance is infinite. Thus this embodiment allows one to construct a current source that has either positive or negative output impedance at low frequencies, and obtain extremely high performance at high frequencies in either case.

In the embodiment of FIG. 8 the resistor 37 could be replaced, if desired, by a generalized impedance, Z. The output impedance of the improved current mirror can be described as two parallel impedances, the first of which is equal to $B^2ro/(G+1)$ (as described above), and the second of which has a value of $-Z(Va)/Vt$. Thus, any arbitrary impedance in place of resistor 37 can be reflected to the output of the improved current mirror with a change in sign, thus allowing the realization of negative output capacitance or negative output inductance.

In all of the embodiments of the invention shown herein the current mirrors utilize a PNP collector as the output terminal, providing a source of current. It will be understood by those skilled in the art that all these current mirrors can be made with an NPN collector as the output terminal, thereby providing a sink of current. All that is necessary is to replace all PNP transistors with NPN's, all NPN transistors with PNP's, and to invert the polarity of the voltage source V supplying power to the circuit.

It will also be understood by those skilled in the art that current mirrors can be made from devices other than bipolar transistors, such as field effect transistors, vacuum tubes, etc. Any or all of the bipolar transistors in the above shown embodiments may be replaced with these other devices without changing the intent or operation of the circuits of the invention.

For the purposes of this invention and the appended claims, reference to "transistor" shall include any electronic device, simple or compound, having at least common, input, and output terminals, and constructed so that a current flowing through said output terminal to said common terminal is responsive to a voltage difference existing at said input terminal with respect to said common terminal. Additionally, reference herein to "emitter", "base", and "collector" terminals of said transistor shall be construed to apply to said common, input, and output terminals of said electronic device.

For example, a reference to "transistor having emitter, base, and collector terminals" shall be construed as a reference to "bipolar transister having emitter, base, and collector terminals", to "field effect transistor having source, gate, and drain terminals," to "junction field effect transistor having source, gate, and drain terminals," respectively. A similar construction shall be applied to the other types of transistor devices as described above.

What is claimed is:

1. An improved current mirror having input and output terminals, and further comprising:
   (a) a simple current mirror having input and output terminals, and a bias terminal for connection to a voltage source;
   (b) unit gain buffer having input and output terminals; and
   (c) a first transistor having emitter, base and collector terminals;

wherein said input terminal of said buffer is connected in common with said output terminal of said simple current mirror to form said input terminal of said improved current mirror; wherein said output terminal of said buffer is connected to said base terminal of said first transistor; wherein said emitter terminal of said first transistor is connected to said input of said simple current mirror; and wherein said collector terminal of said first transistor comprises said output terminal of said improved current mirror; and wherein said buffer includes means for causing a correction current to flow through said input terminal of said buffer, said correction current being responsive to the operation of said simple current mirror and in the proper sense to reduce the error current between said input terminal and said output terminal.

2. An improved current mirror having input and output terminals, and further comprising:
   (a) a simple current mirror having input and output terminals, and a bias terminal for connection to a voltage source;
   (b) a first transistor having emitter, base and collector terminals;
   (c) unity gain buffer having input, output and feedback terminals; wherein said buffer includes means for controlling a current through said feedback terminal sensitive to a current flowing in said base of said transistor;

wherein said input terminal of said buffer is connected in common with said output terminal of said simple current mirror to form said input terminal of said improved current mirror; wherein said output terminal of said buffer is connected to said base terminal of said first transistor; wherein said feedback terminal of said buffer is connected in common to said emitter terminal of said first transistor and to said input terminal of said simple current mirror; and wherein said collector terminal of said first transistor comprises said output terminal of said improved current mirror.

3. An improved current mirror having input and output terminals, and further comprising:
   (a) a simple current mirror having input and output terminals, and a bias terminal for connection to a voltage source;
   (b) unity gain buffer having input and output terminals; and
   (c) a first transistor having emitter, base and collector terminals;

wherein said input terminal of said buffer is connected in common with said output terminal of said simple current mirror to form said input terminal of said improved current mirror; wherein said output terminal of said buffer is connected to said base terminal of said first transistor; wherein said emitter terminal of said first transistor is connected to said input of said simple current mirror; and wherein said collector terminal of said first transistor comprises said output terminal of said improved current mirror; wherein said unity gain buffer comprises a second transistor and first bias means for biasing said second transistor; wherein said second transistor includes base, emitter, and collector terminals; wherein said base terminal of said second transistor comprises said input terminal of said buffer; wherein said emitter terminal of said second transistor comprises said output terminal of said buffer; and wherein said collector terminal of said second transistor is connected to said first bias means; wherein said first and second transistors are of the same polarity; further comprising second bias means which comprises (a) first and second diodes, (b) a resistor, and (c) a first voltage source; wherein said diodes and said resistor are connected in series between said first voltage source and said emitter terminal of said second transistor in a manner such that said second transistor is biased on.

4. An improved current mirror having input and output terminals, and further comprising:

(a) a simple current mirror having input and output terminals, and a bias terminal for connection to a voltage source;

(b) unity gain buffer having input and output terminals; and (c) a first transistor having emitter, base and collector terminals;

wherein said input terminal of said buffer is connected in common with said output terminal of said simple current mirror to form said input terminal of said improved current mirror; wherein said output terminal of said buffer is connected to said base terminal of said first transistor; wherein said emitter terminal of said first transistor is connected to said input of said simple current mirror; and wherein said collector terminal of said first transistor comprises said output terminal of said improved current mirror; wherein said unity gain buffer comprises a second transistor and first bias means for biasing said second transistor; wherein said second transistor includes base, emitter, and collector terminals; wherein said base terminal of said second transistor comprises said input terminal of said buffer; wherein said emitter terminal of said second transistor comprises said output terminal of said buffer; and wherein said collector terminal of said second transistor is connected to said first bias means; and further comprising second bias means comprising (a) a resistor, (b) a voltage source, and (c) a third transistor having base, emitter and collector terminals; wherein said simple current mirror includes input and output transistors each having base, emitter and collector terminals; wherein the base terminals of said input, output, and third transistors are connected together in common with said collector terminal of said input transistor and said emitter terminal of said first transistor; wherein said collector terminal of said third transistor is connected to said emitter terminal of said second transistor; wherein said emitter terminal of said third transistor is connected in series with said resistor and said voltage source; and wherein said first, second and third transistors are of the same polarity.

5. An improved current mirror, having input and output terminals, and further comprising:

(a) a simple current mirror having input and output terminals, and a bias terminal for connection to a voltage source;

(b) unity gain buffer having input and output terminals; and (c) a first transistor having emitter, base and collector terminals;

wherein said input terminal of said buffer is connected in common with said output terminal of said simple current mirror to form said input terminal of said improved current mirror; wherein said output terminal of said buffer is connected to said base terminal of said first transistor; wherein said emitter terminal of said first transistor is connected to said input of said simple current mirror; and wherein said collector terminal of said first transistor comprises said output terminal of said improved current mirror; and wherein said unit gain buffer comprises:

(a) a second transistor having base, emitter and collector terminals; wherein said second transistor and said first transistor are of opposite polarity;

(b) bias means for biasing said second transistor;

wherein said base terminal of said second transistor comprises said input terminal of said buffer; wherein said emitter terminal of said second transistor comprises said output terminal of said buffer; wherein said collector terminal of said second transistor is connected in common with said emitter terminal of said first transistor and said input terminal of said simple current mirror; and wherein said bias means is connected to said emitter of said second transistor.

6. An improved current mirror in accordance with claim 5, wherein said bias means comprises a current source.

7. An improved current mirror in accordance with claim 6, wherein said bias means further comprises a resistor connected in parallel with said current source.

* * * * *